United States Patent [19]

Dürr

[11] 3,957,210

[45] May 18, 1976

[54] STIRRING MILL

[75] Inventor: Herbert Dürr, Mannheim, Germany

[73] Assignee: Draiswerke GmbH, Mannheim, Germany

[22] Filed: Aug. 9, 1974

[21] Appl. No.: 496,164

[30] Foreign Application Priority Data

Aug. 11, 1973 Germany ..... 2340726
July 9, 1974 Germany ..... 2432860

[52] U.S. Cl. ..... 241/46.02; 241/46.11; 241/171; 241/247; 425/207

[51] Int. Cl.[2] ..... B02C 23/36

[58] Field of Search ..... 241/46.02, 46.11, 46.15, 241/46.17, 171, 186 A, 246, 247; 425/207

[56] References Cited

UNITED STATES PATENTS

| | | | |
|---|---|---|---|
| 1,929,395 | 10/1933 | Barton | 425/207 |
| 2,669,924 | 2/1954 | Wiemer | 241/186 A X |
| 2,719,325 | 10/1955 | Franklin | 425/207 X |
| 2,722,163 | 11/1955 | Cumpston, Jr. | 241/186 A |
| 2,855,156 | 10/1958 | Hochberg et al. | 241/46.17 X |
| 3,278,987 | 10/1966 | Rodenacker et al. | 425/376 |
| 3,458,144 | 7/1969 | Lessells et al. | 241/46.02 |
| 3,611,488 | 10/1971 | Hoffmann | 425/376 |
| 3,785,760 | 1/1974 | Johnson | 425/207 |
| 3,788,567 | 1/1974 | Yamada | 241/247 |

*Primary Examiner*—Granville Y. Custer, Jr.
*Attorney, Agent, or Firm*—Browdy and Neimark

[57] ABSTRACT

An apparatus for the continuous dispersion and fine grinding of substances in a liquid or liquefiable dispersion medium, comprises of a cylindrical vessel, in the grinding chamber of which is disposed a coaxial stirrer shaft, which is adapted to be driven rotationally and is equipped with mixing tools, and a filling of grinding elements, the grinding chamber being immediately preceded by a device for mixing the substances with the dispersion medium.

8 Claims, 5 Drawing Figures

STIRRING MILL

BACKGROUND OF THE INVENTION

Stirrer mills for the continuous fine grinding and/or dispersion of, in particular, solid materials in liquids are for example known from U.S. Pat. No. 2,855,156; in this connection it must be borne in mind that as a rule the part played by dispersion on the one hand and fine grinding on the other hand in the course of a process may vary, that is to say in certain cases dispersion may be more important and grinding less important, or vice versa.

Stirrer mills of this kind usually consist of an upright or horizontal grinding vessel in which a stirrer, usually composed of discs, rotates at high speed. The grinding elements used may be a filling of sand or of steel or glass beads or the like. The material to be ground is pumped to the grinding vessel of the stirrer mill at one end, leaving the mill at the other end after being separated from the grinding elements. Experience has shown that predispersed pumpable material to be ground must be fed to stirrer mills. For the premixing or predispersion use is generally made of mixing machines or stirrers of large volume in which, for example, the solids and liquids are brought into contact with one another. Apart from the enormous expense for apparatus entailed by such premixing machines, the quality of the premixing has been shown by experience not to be sufficiently effective to prevent the occurrence of a considerable quantity of solid agglomerates of substantial size, since in mixers of this kind the components of the mixture are acted on only with statistical probability. After the mixing process the mixture of liquid and material to be ground is fed through metering pumps and pipes to the stirrer mill. Because of the previously mentioned solid agglomerates, however, the performance of the stirrer mill is considerably reduced, quite apart from the resulting difficulties in the metering pumps and pipes.

From German Patent No. 1,227,767 it is already known to separate a premixing chamber in the bottom region of the vessel from the actual mixing chamber by means of a sieve. The dispersion liquid and solid materials are each introduced separately into this premixing chamber, while metering worms may be provided for the introduction of the solids. The premixing is effected by means of mixing tools mounted on an extension of the stirrer shaft, or by means of a separate and separately driven mixing unit. It has been found that the solids briquette or agglomerate in the conveyor worms, since as a rule considerable pressures occur in the latter, if only because conveying is effected against the static pressure of the stirrer mill. These agglomerates cannot be adequately comminuted in the premixing chamber, so that known stirrer mills do not work satisfactorily. Furthermore, the dividing sieve which is provided between the premixing chamber and the grinding chamber, and which, because of the usually small diameter of the grinding balls (0.3 to 3mm), must be a fine mesh sieve, is clogged by these agglomerates, so that the stirrer mill is then subject to frequent breakdowns. Furthermore, clogging often occurs in these conveyor worms, so that the latter no longer operate but are brought to a halt.

From German Patent No. 1,249,649 it is known for the material to be ground, which is in paste form and is not mixed with an additional dispersion medium, to be delivered by means of a conveyor worm to the grinding chamber of a stirrer mill.

SUMMARY OF THE INVENTION

The problem underlying the invention consists in so developing an apparatus of the kind first described above that with little expense for apparatus reliable premixing of substances and dispersion media is achieved without any danger occurring of the clogging of the mill.

According to the invention, this problem is solved by providing, upstream of the grinding chamber, a mixing worm which serves as device for mixing the substances with the dispersion medium and which in turn is immediately preceded by separate metering devices for substances and dispersion medium. The steps taken according to the invention ensure that in the mixing worm excellent premixing of the substances and dispersion medium is effected substantially without the formation of agglomerates. Owing to the fact that the dispersion medium is also introduced directly into the mixing worm, it is made impossible for the substances, which are usually in the form of solid substances, to agglomerate or briquette and to clog the worm. In addition, it is impossible for the premixed substances and dispersion medium to separate again on their way to the grinding chamber, since they are transferred directly from the worm to the treatment stage in the grinding chamber, which is filled with auxiliary grinding elements to the extent of from 40 to 80 percent.

The invention is based on the following considerations which have been substantiated by exhaustive experiments:

If a continuously working mixing machine, for example a worm mixer, is continuously fed in the correct proportion with metered amounts of, for example, a pulverulent solid and a suitable dispersion medium, which is for example in liquid form, the worm machine can be operated with a throughput which corresponds to a multiple of that otherwise customary. Under the influence of the direct action of gravity, the formation of secondary agglomerates of the pulverulent solid components is avoided in this process. According to the invention, the resulting pretreated mixture is fed, without interruption in respect of time and space, directly to a stirrer mill for fine dispersion and fine grinding. It is then found that, because of the direct merging of the mixing and grinding processes, the working capacity of the stirrer mill is substantially increased and it supplies a far more uniform final product than in conventional processes in which, after the premixing process in mixing or stirring vessels of large volume, not only is a substantially poorer starting material obtained for the stirrer mill but in addition formulation variations through segregation processes in the stirring vessel itself and/or in the pipes and pumps are unavoidable, resulting in the consequent disturbances and operational breakdowns.

The invention will be explained with the aid of an example.

A printing ink, consisting of 200 kg of soot and 800 kg of binder, is prepared. The conventional procedure provides for first premixing the soot and binder. For this purpose use is made of a mixing vessel having a capacity of about 1500 liters and a mixing apparatus which is known as a dissolver and is customary in industrial practice. For the batch indicated a dissolver having a driving power of 60 HP is necessary. The binder is first introduced into the mixing vessel and the soot is continuously added during the running of the dissolver. In order to achieve premixing, such as is normally required to obtain material for feeding stirrer mills, it is necessary to run the dissolver for 40 minutes. After the premixing the dispersed material is drawn by means of a suitable metering pump out of the sump of the mixing vessel and fed to a stirrer mill having a grinding vessel capacity of 125 liters. The stirrer mill of this size is equipped with a driving motor of 122 HP. For the fine grinding of the batch indicated in the stirrer mill a total time of passage of 1 hour 20 minutes is required.

In the present invention use is made of apparatus according to the invention, that is to say a worm machine having a driving power of 15 HP is fastened to the grinding vessel of the stirrer mill having a grinding capacity of 125 liters, in other words the mixing chamber of the worm machine merges without spatial separation into the grinding chamber of the stirrer mill. The stirrer mill part of the apparatus of the invention is equipped with the same elements as the above-described stirrer mill used in the conventional process. However, both the binder and the soot required for the production of the printing ink are now charged continuously and directly to the worm machine in a continuous flow and in the correct quantitative ratio, namely 4:1. In the worm machine the components in question are subjected to continuous intensive mixing, and this mixing process merges directly into a grinding process in the stirrer mill. In the process of the invention and with the apparatus of the present invention a passage time of only one hour is required. The surprising feature consists in that through the mixing process, which without interruption in respect of space or time merges into a grinding process, the working capacity of the stirrer mill is substantially improved despite the fact that substantially less energy is expended for the premixing than in the above-described process. Furthermore, the metering and control device of the continuously operating mixing worm is at the same time used as control device for the stirrer mill, so that the expense otherwise incurred for additional equipment is here eliminated.

In another advantageous development, provision is made for using a worm machine which is in the form of a single shaft or multi-shaft mixing worm machine producing shearing forces and which transfers the material which is to be mixed or ground to the stirrer mill under pressure. The incorporation of cam discs disposed in the form of a spiral staircase can additionally produce favorable mixing effects.

For certain mixing purposes it is particularly advantageous for individual components of the complete mixture, or parts of such components, not to be fed directly to the worm machine through the inlet hopper, but to be added at a later moment to the worm machine or stirrer mill. Another metering device will therefore be optionally added to the worm machine, for example, in the second half of the length of the worm.

If the mixing worm machine is provided with a device for forced delivery, it can be made completely impossible for the worm to become clogged, even with highly adhesive substances. A forced delivery device of this kind may be formed by a gear meshing with the worm thread and free to participate in the rotation. It may, however, also be formed by balls meshing with the worm thread and rotating on a closed path. The same effect of forced delivery is also achieved if the mixing worm machine is constructed with two shafts and the two worms intermesh, that is to say when driven in opposite directions they also have oppositely extending worm threads. In this case it is expedient for only one of the two worms to lead into the stirrer mill, in order to prevent the grinding elements from passing between the worms, in the region where the worm leads into the mill, and from being ground up there. In any case, the mixing effect of the mixing worms is essentially produced by the shearing action of the worms, which in turn is essentially achieved through the relatively slight clearance between the worm threads and the worm casing. Furthermore, the great advantage of mixing worms is that they can also be operated with a partial filling, that is to say mixing worms do not need to be adapted to different thoughput capacities of the stirrer mill.

For the purpose of adaptation to different viscosities of materials to be mixed and ground, in the apparatus of the invention the grinding element separating device of the stirrer mill will be adapted to the viscosities in question. In the case of low to medium viscosities a sieve, for example in the form of a cylinder, at the outlet of the stirrer mill, will be sufficient to separate the grinding elements. In the case of high viscosities it is advisable to use a so-called annular gap separating device, which consists of a ring fastened on the grinding vessel and of a disc rotating with the stirring shaft, a determined gap width being adjusted between the ring and the disc.

In certain cases it may be advantageous to provide on the stirrer mill an additional worm machine for further homogenization.

BRIEF DESCRIPTION OF DRAWING

Further details of the invention can be seen from the examples of embodiment illustrated in the drawings, in which.

DETAILED DESCRIPTION OF THE INVENTION

Figure 1:
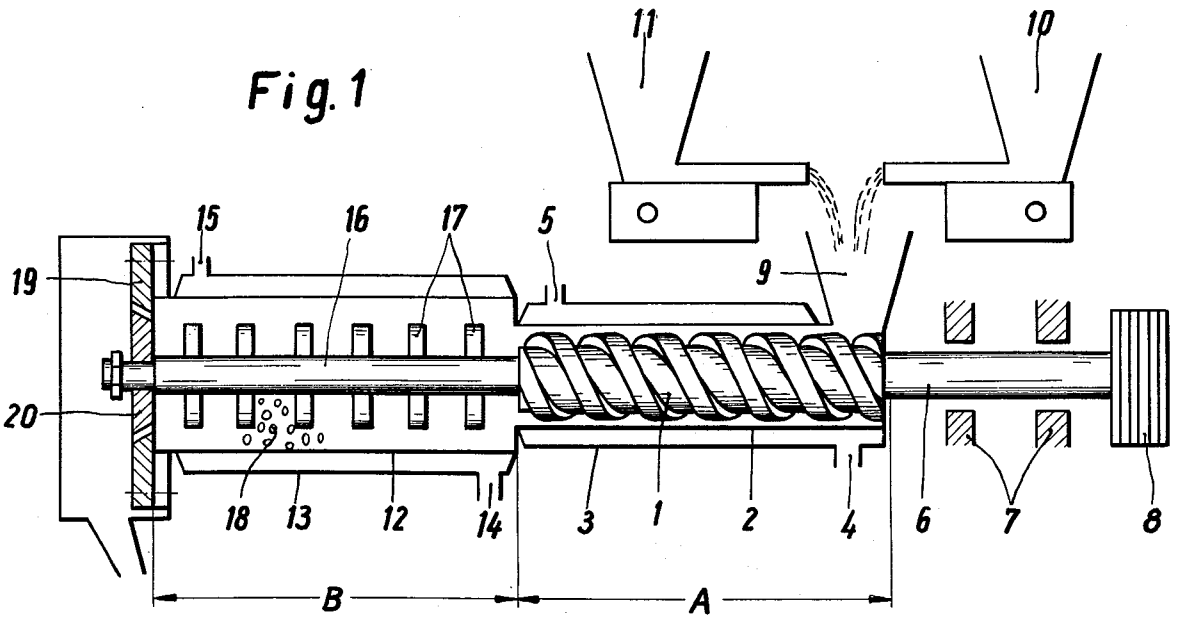
FIG. 1 schematically shows a horizontal stirrer mill preceded by a mixing worm, wherein the worm shaft and stirrer shaft are in line with one another.

FIG. 1 is a longitudinal section in schematic form of an apparatus according to the present invention. A designates a mixing worm machine, and B a stirrer mill directly adjoining it. The worm machine together with a worm 1 is accommodated in a casing 2, which is provided with a double jacket 3 having an inlet aperture 4 and an outlet aperture 5 for a heating or cooling liquid. The worm 1 is mounted on a shaft 6 guided in bearings 7. In this figure the drive is indicated by a drive pinion 8. At the drive end the casing 2 of the worm machine is interrupted by a feed hopper 9. Two metering devices 10 and 11 supply to the mixing worm machine the material which is to be mixed and ground.

In FIG. 1 the two metering devices 10, 11 are shown for the metering of free flowing solids, of which solids one may be a dispersion medium capable of liquefaction, for example through the action of temperature and/or pressure, for example wax, the other solid then being dispersed and ground therein. The horizontally disposed stirrer mill B consists of a grinding vessel 12 connected to the casing 2 of the worm machine and provided with a double jacket 13 with an inlet aperture 14 and outlet aperture 15 for a heating or cooling liquid. In this case a stirrer shaft 16 is fastened to the drive shaft 6 of the worm machine. Stirrer discs 17 are fastened on the stirrer shaft 16. Grinding elements 18 fill a certain part of the grinding vessel 12, namely about 40 to 80 percent. The shape of the stirrer discs 17 is adapted to the material to be treated in each particular case and also to the type, quantity and size of the grinding elements 18.

The purpose of separating the grinding elements from the ground material is served by a separating device which is disposed at the other end of the vessel, and which here consists of a so-called annular gap separating device, which is composed of a ring 19 fastened on the grinding vessel and of a disc 20 rotating with the stirring shaft 16. Between the ring and the rotating disc a gap is adjusted, which is equal to or smaller than half the diameter of the smallest grinding element used.

Figure 2:
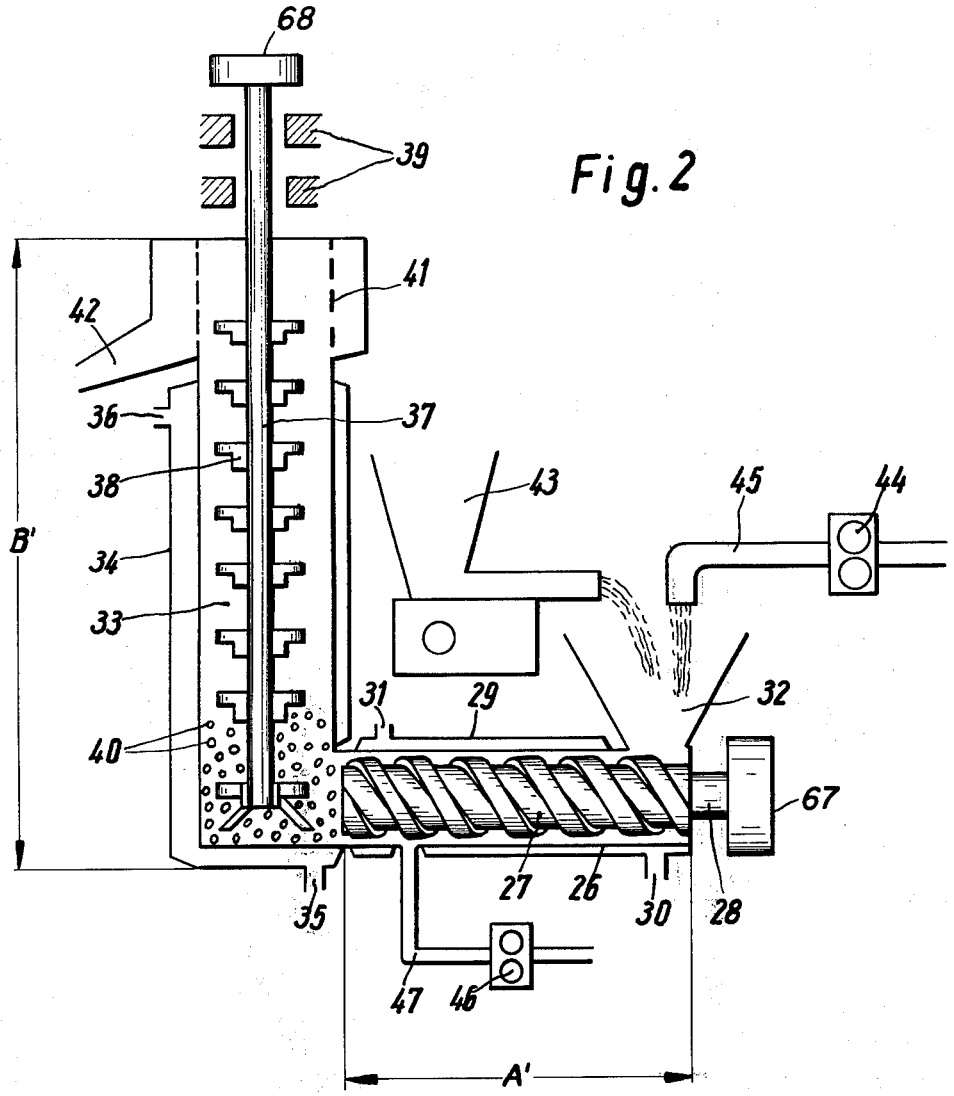
FIG. 2 shows schematically an upright stirrer mill through which the material flows from bottom to top and which has a mixing worm disposed horizontally at its bottom end.

FIG. 2 is a longitudinal section in schematic form through an apparatus according to the invention in which the worm machine A′ and stirrer mill B′ are disposed at an angle to one another. The horizontally extending worm A′ and the upright stirrer mill B′, through which the material passes from bottom to top, have in this case their own separate driving means respectively 67, 68, which rotate at the same or different speeds. The casing 26 of the worm machine A′ contains a worm 27 mounted on a shaft 28. The mounting of the worm shaft is not shown here. The casing 26 with its double jacket 29, provided with the inlet aperture 30 and the outlet aperture 31, is interrupted at the drive end by an inlet hopper 32. The worm machine A′ is joined directly to the grinding vessel 33 of the stirrer mill B′. The grinding vessel 33 is provided with a double jacket 34 having an inlet aperture 35 and an outlet aperture 36 for a cooling or heating liquid. The stirrer shaft 37 with stirring discs 38 and a mounting 39 rotates in the grinding vessel 33 in the presence of the grinding elements 40. Here again the shape of the stirring discs 38 and the type, quantity and size of the grinding elements 40 correspond to the material being mixed and ground in each particular case. At the upper end of the grinding vessel 33 a separating device 41 which is here shown as a cylindrical sieve, serves to separate the grinding elements 40 from the ground material. The latter leaves the stirrer mill B′ via an outlet 42.

For the continuous metering of the solid component use is made of a metering device 43 shown here, while the dispersion medium, which is for example in liquid form, is fed to the worm machine by way of a pipe 45 by a metering pump 44. Another component, for example in liquid form, is fed to the worm machine A′ by means of a metering pump 46 by way of a corresponding pipe 47 in the second half of the length of the worm.

In cases where the material to be treated consists of a plurality of solid components or of dispersion medium components, metering must naturally be effected for each component. It is however also entirely possible for solid components having similar metering properties to be previously grouped together or premixed and conjointly fed by way of a single metering device.

Figure 3:
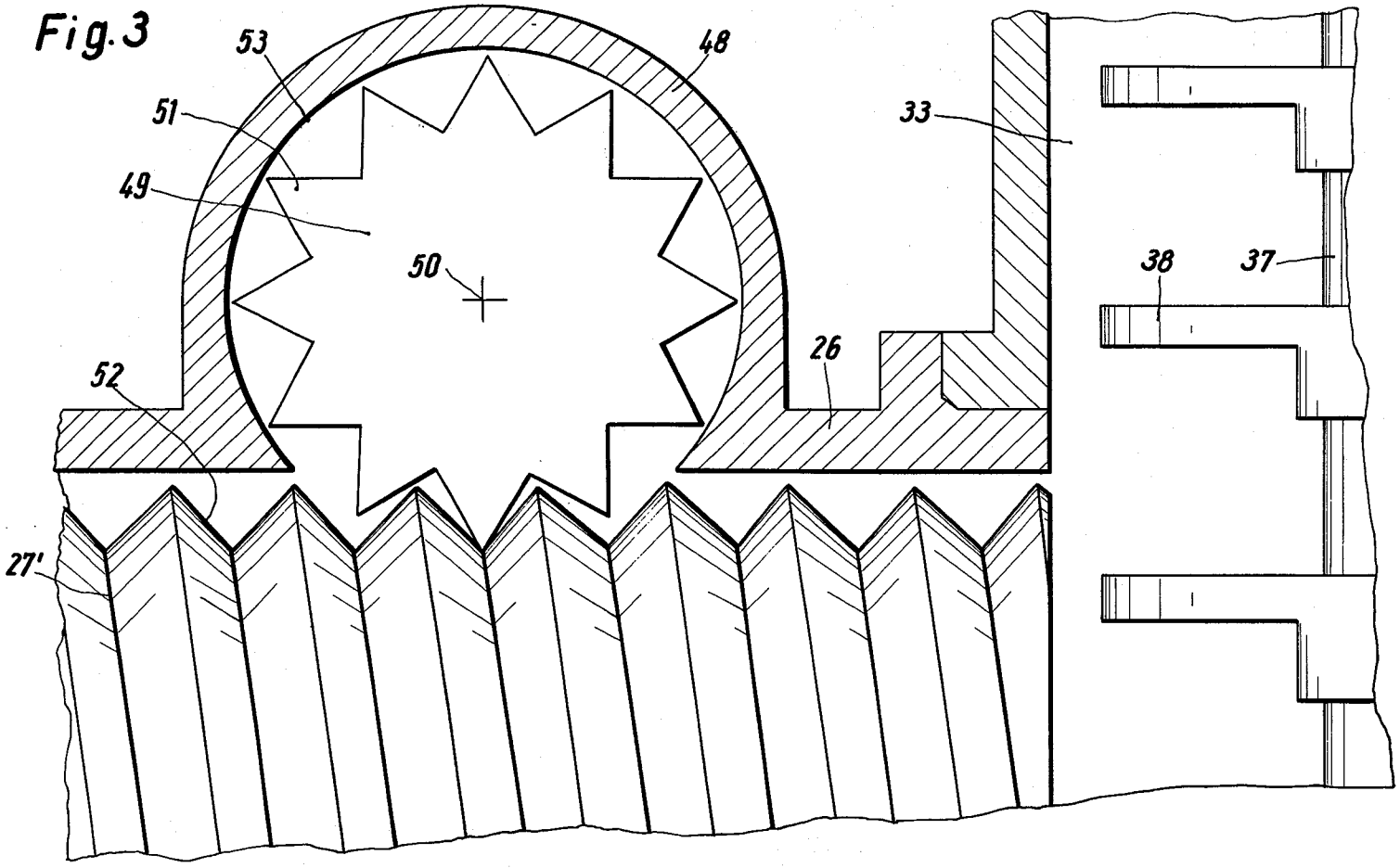
FIG. 3 shows a side elevational partially cut away view of a mixing worm with a forced delivery device consisting of a gear.

As can be seen in FIG. 3, a suitably widened portion 48 of the casing 26 contains a gear 49 which is freely rotatable about its axis 50 and the teeth 51 of which mesh in the correspondingly adapted grooves 52 of the worm 27′. On its inner side the widened portion 48 is so shaped that the tips of the teeth 51 have only slight clearance in relation to the inner wall 53 of the widened portion 48. As can be seen in the drawings, at least one tooth 51 almost completely fills the corresponding worm thread 52, so that from that point forced delivery of the substances contained in the worm is effected in the direction of the stirrer mill.

Figure 4:
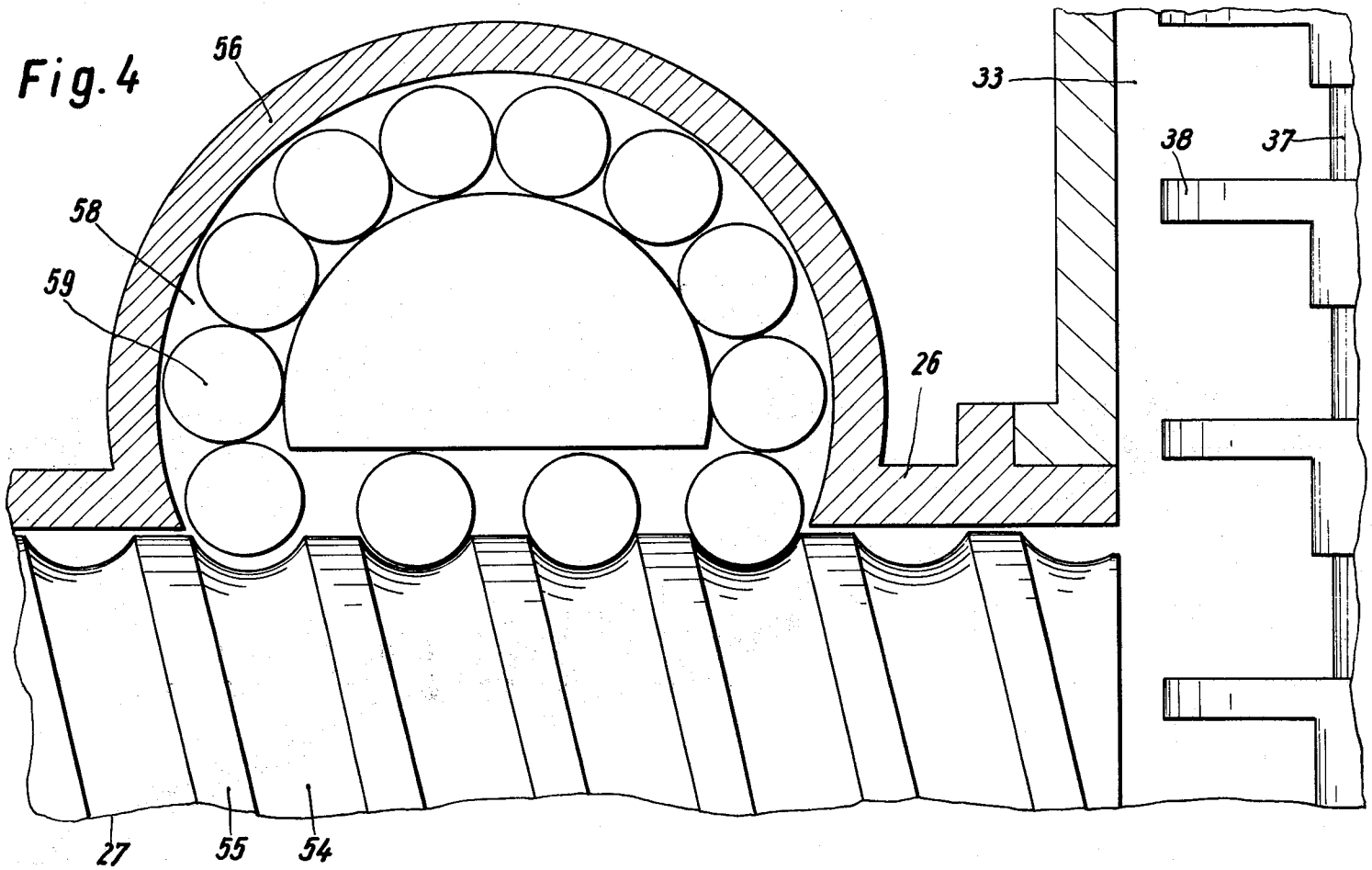
FIG. 4 shows a side elevational partially cut away view of a mixing worm with balls circulating on a closed path to serve as forced delivery device.

In the variant shown in FIG. 4 the worm 27 has grooves 54 whose section has the shape of an arc of a circle between the worm threads 55. In the casing 26 a widened portion 56 is provided in which a circulation passage 58 is provided. This circulation passage 58 is filled with balls, each of which takes up position in the worm grooves 54, thus blocking the latter so that once again forced delivery is effected. The individual balls 59 circulate in the counterclockwise direction in this arrangement. They are guided laterally by the corresponding side walls of the track 58.

Figure 5:
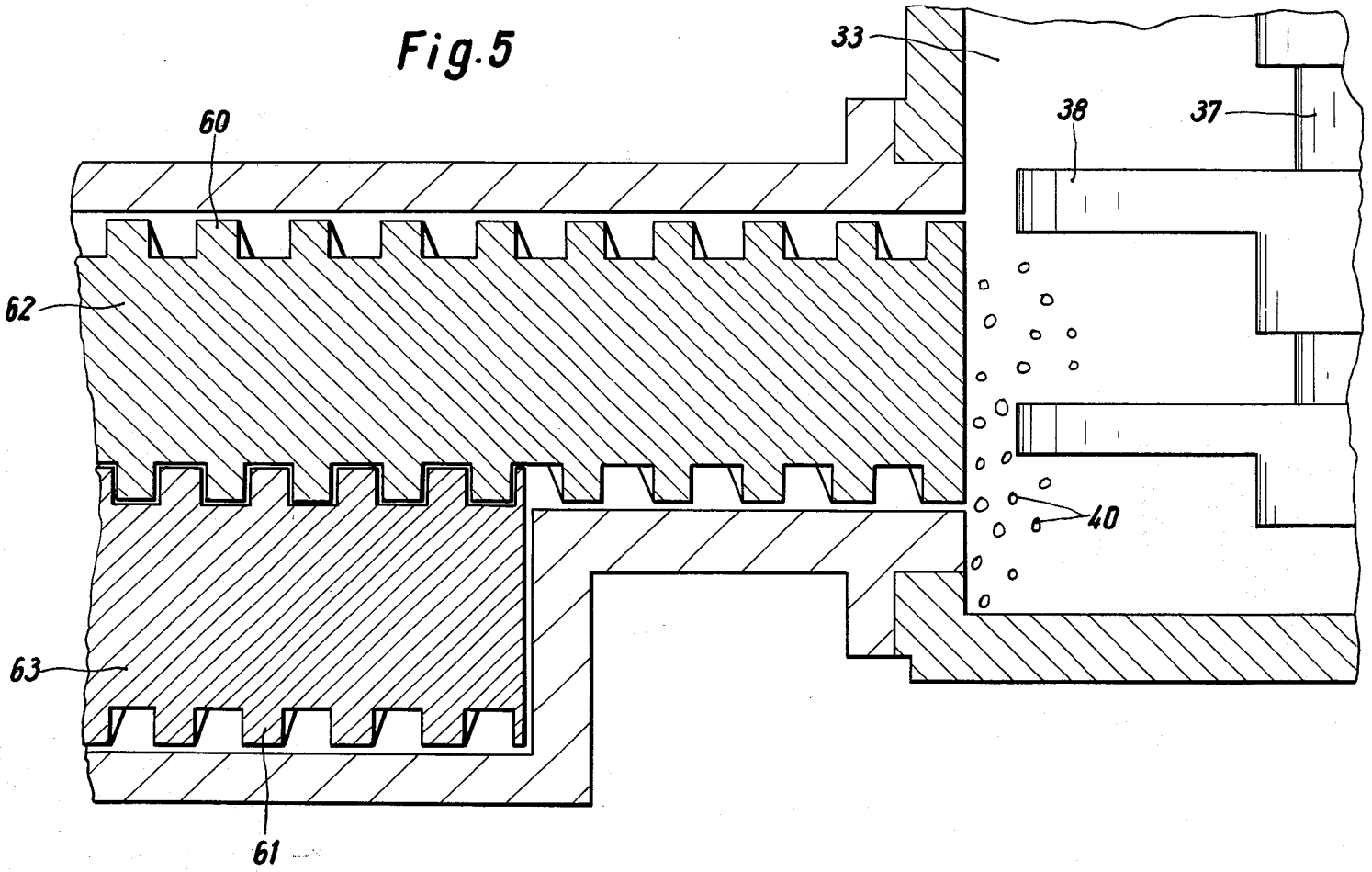
FIG. 5 shows a side elevational cut away view of a two-shaft mixing worm.

In the variant shown in FIG. 5 a two-shaft worm machine is provided in which the worm threads 60 and 61 of the two worms 62 and 63 respectively intermesh and roll against one another. One worm 63 ends before the entry to the stirrer mill, so that on the one hand forced delivery and good premixing are achieved, while on the other hand the danger that grinding elements 40 will come between the threads 60 and 61 of the two worms 62 and 63 respectively is eliminated.

I claim:

1. A stirrer mill for the continuous dispersion and fine grinding of substances which tend to briquette or agglomerate in a liquefiable dispersion medium, comprising:

grinding means including a cylindrical vessel, a stirrer shaft within said vessel and coaxial therewith, mixing tools disposed on said stirrer shaft, grinding elements disposed and retained within said vessel, and means for driving said shaft;

mixing means immediately preceding and directly feeding into said grinding means, said mixing means consisting essentially of a cylindrical chamber, a mixing worm disposed coaxially within said cylinder chamber, and means for driving said worm; and metering means, immediately preceding and feeding directly into said mixing means, for dispensing metered quantities of substances and dispersion medium into said mixing means.

2. A stirrer mill in accordance with claim 1 wherein said mixing means further comprises an inlet hopper at the end of said cylindrical chamber opposite said grinding means and wherein said metering means are for dispensing metered quantities of substances and dispersion medium into said inlet hopper.

3. A stirrer mill in accordance with claim 2 further comprising an additional means for dispensing metered quantities of substances or dispersion medium into said mixing means downstream — as viewed in the direction of delivery — of said inlet hopper.

4. A stirrer mill in accordance with claim 1 wherein said mixing means further includes forced delivery means for forcing the substances and dispersion medium being mixed into said worm to allow delivery in the direction of said grinding means.

5. A stirrer mill in accordance with claim 4, wherein said forced delivery means comprises a gear meshing with the grooves of said worm and freely participating in the rotation thereof.

6. A stirrer mill in accordance with claim 4, wherein said forced delivery means comprises balls circulating on a closed path and meshing with the grooves of said worm.

7. A stirrer mill in accordance with claim 4 wherein said forced delivery means comprises a second worm intermeshing with said first worm.

8. A stirrer mill in accordance with claim 7 wherein said second worm does not lead into said grinding means.

* * * * *